US008142206B2

(12) United States Patent
Zhang et al.

(10) Patent No.: US 8,142,206 B2
(45) **Date of Patent: *Mar. 27, 2012**

(54) ELECTRICAL CONNECTOR HAVING CONTACT ARRANGEMENT ENSURING RELIABLE HIGH SPEED TRANSMISSION

(75) Inventors: Xin-Jie Zhang, Kunshan (CN); Chun-Hsiung Hsu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 20 days.

This patent is subject to a terminal disclaimer.

(21) Appl. No.: 12/952,255

(22) Filed: Nov. 23, 2010

(65) Prior Publication Data

US 2011/0070779 A1 Mar. 24, 2011

Related U.S. Application Data

(63) Continuation of application No. 12/721,575, filed on Mar. 11, 2010, now Pat. No. 7,841,872.

(51) Int. Cl.
*H01R 12/00* (2006.01)

(52) U.S. Cl. ..... 439/79

(58) Field of Classification Search ..... 439/59–61, 439/79–80, 660
See application file for complete search history.

(56) References Cited

U.S. PATENT DOCUMENTS 7,841,872 B2 * 11/2010 Zhang et al. ..... 439/79
2007/0173127 A1 7/2007 Regnier et al.

* cited by examiner

*Primary Examiner* — Phuong Dinh
(74) *Attorney, Agent, or Firm* — Ming Chieh Chang; Wei Te Chung; Andrew C. Cheng

(57) ABSTRACT

An electrical connector (100) includes an insulative housing (10) defining a receiving room (110) for receiving a mating connector, and a receiving cavity (16) below and separated from the receiving room for receiving a portion of the mating connector. A number of contacts are supported by said insulative housing, and arranged in distinct sets of upper and lower contacts (20, 30) on opposing faces of said insulative housing. The upper and the lower contacts are inserted into the receiving room along a back-to-front direction. An elongated spacer (40) is supported by said insulative housing. The upper contacts are arranged by the elongated spacer.

16 Claims, 6 Drawing Sheets

ELECTRICAL CONNECTOR HAVING CONTACT ARRANGEMENT ENSURING RELIABLE HIGH SPEED TRANSMISSION

This application is a continuation application of application Ser. No. 12/721,575 filed on Mar. 11, 2010 now U.S. Pat. No. 7,841,872.

BACKGROUND OF THE INVENTION

1. Field of the Invention

The present invention relates to an electrical connector, and more particularly to an electrical connector with a number of contacts suitable for high speed communication.

2. Description of Related Arts

U.S. Pub. No. 20070173127, published on Jul. 26, 2007, to Regnier et al. discloses a related art. According to the disclosure, a surface mount connector for high speed data transfer application is disclosed and includes an insulative housing with a circuit card-receiving slot disposed along a front face thereof. A plurality of conductive terminals are supported by the housing so that contact portions of the terminals extend into the card slot. The terminals are supported on opposite faces of the insulative housing, specifically the top and bottom faces thereof, and each of the terminals includes a tail portion, a contact portion and a retention portion that engages with the insulative housing so that the contact portions are cantilevered within the insulative housing. The insulative housing includes a hollow recess formed on its bottom that opens to the front of the insulative housing. This recess serves as a keyway that may receive a male portion of an opposing mating connector to ensure the mating connector is oriented properly before engagement.

The conductive terminals are retained in the insulative housing along a top-to-bottom direction so that the conductive terminal must be formed with a retention stick or tab extending transversally and beyond the signal current path for retaining in the housing. Therefore, the retention stick may form an electrical stub. It is detrimental to high speed data transfer of the conductive terminals.

Hence, an improved electrical connector for high speed data transfer application is required to overcome the above-mentioned disadvantages of the related art.

SUMMARY OF THE INVENTION

An object of the present invention is to provide an electrical connector that the signal current transmit through the retention portion.

To achieve the above-mentioned object, an electrical comprises an insulative housing defining a receiving room and a front mating opening communicating with the receiving room for receiving a mating connector, a plurality of upper and lower rear mounting holes communicating with the receiving room, and a receiving cavity below the receiving room for receiving a portion of a mating connector. A plurality of first contacts each has a first contact portion having a first free end, a first retention portion, a first soldering portion and a first connecting portion. A plurality of second contacts each has a second contact portion having a second free end, a second retention portion, a second soldering portion and a second connecting portion. The first and the second contacts are inserted into the receiving room along a back-to-front direction. The first and second contact portions are exposed in the receiving room. The first retention portions are fixed in the upper rear mounting holes respectively. The second retention portions are fixed in the lower rear mounting holes respectively.

According to the present invention, the first and the second contacts are inserted into the insulative housing along a back-to-front direction. It is unnecessary to form a retention stick beyond the signal current path on each of the first and the second contacts. Therefore, the signal current transmission path may go through the retention portion and the performance of the high speed data transfer is improved.

DETAILED DESCRIPTION OF THE PREFERRED EMBODIMENT

Reference will now be made in detail to a preferred embodiment of the present invention.

Figure 1:
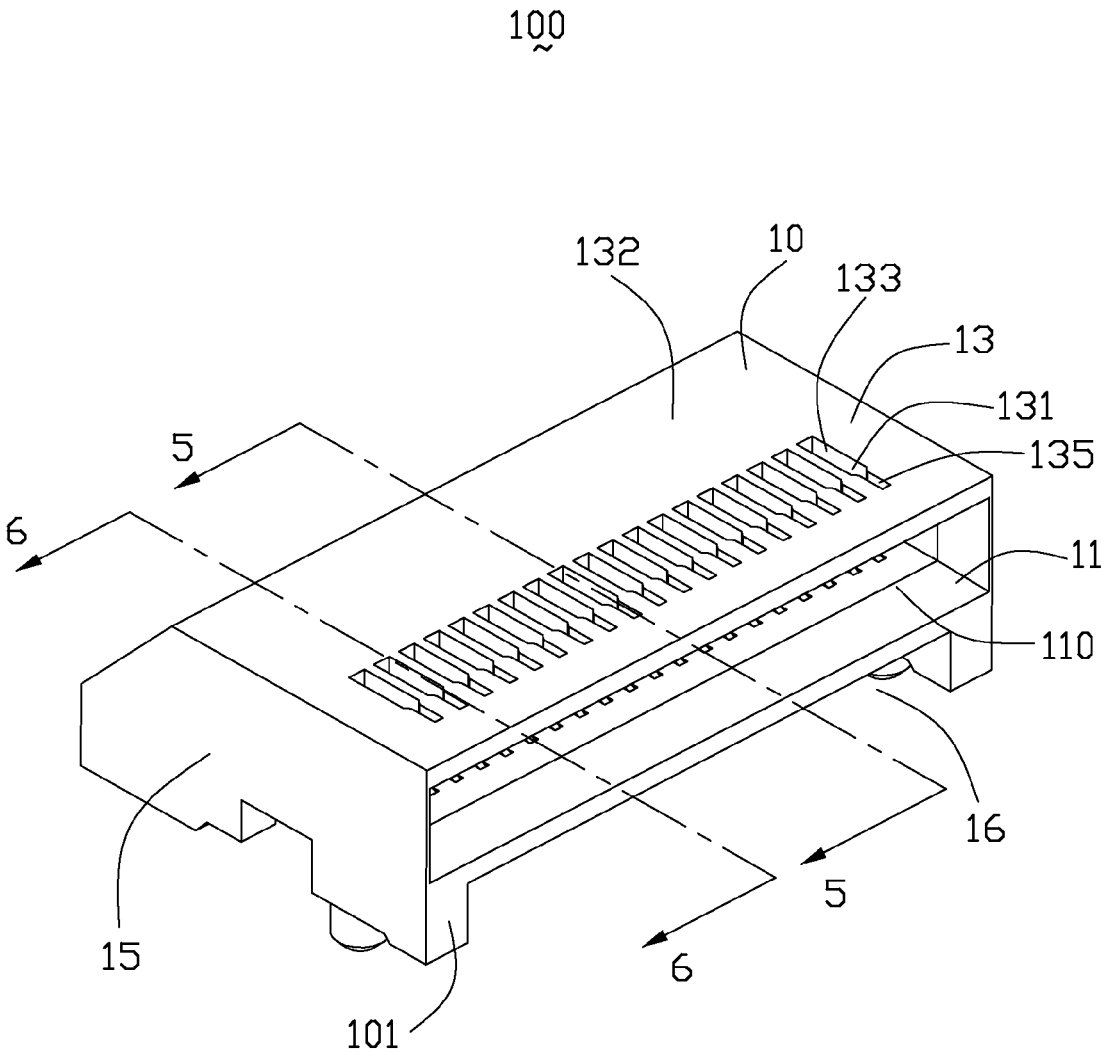
FIG. 1 is a perspective view of an electrical connector for high speed data transfer application in accordance with the present invention.
Figure 2:
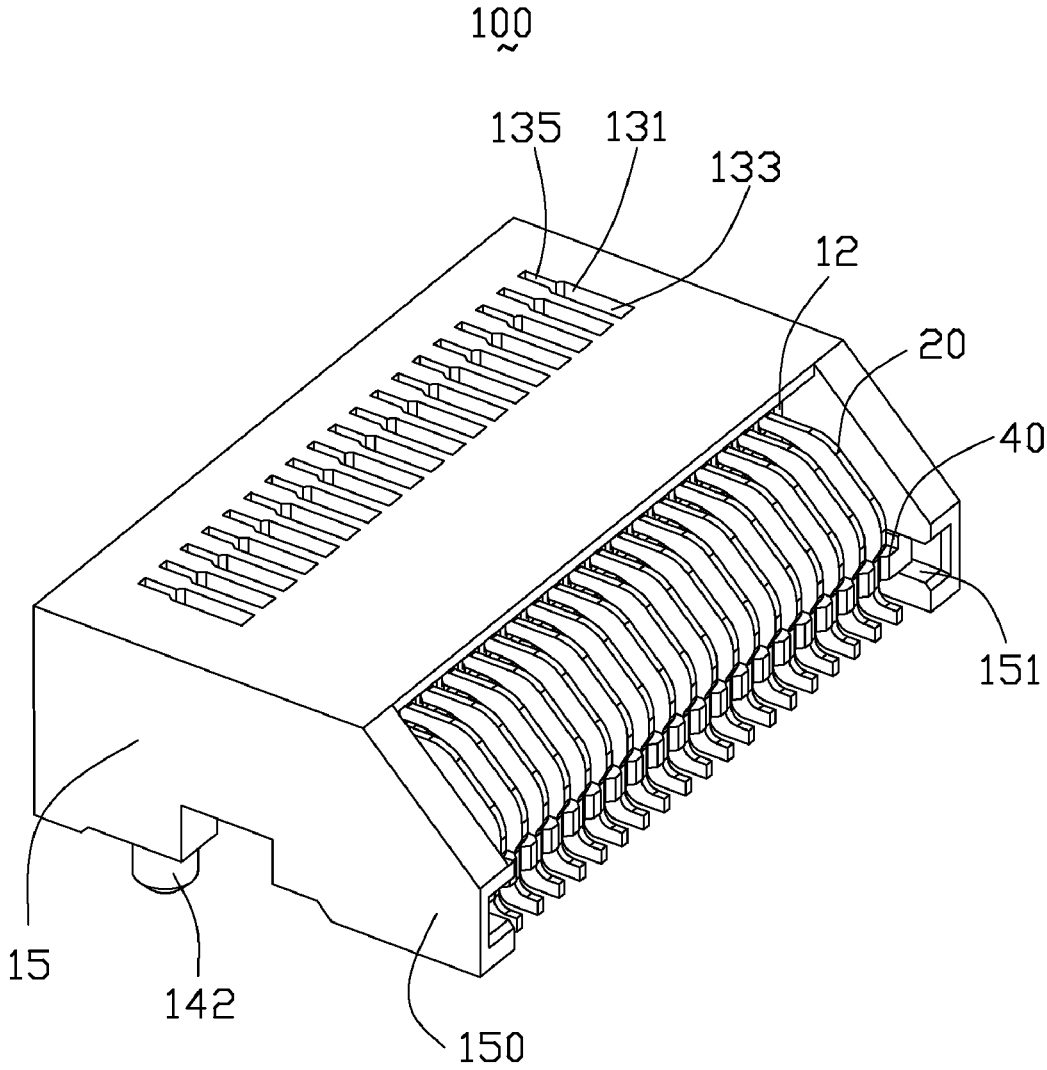
FIG. 2 is another perspective view of the electrical connector as shown in FIG. 1.

Referring to FIGS. 1 to 2, an electrical connector 100 for high speed data transfer application made in accordance with a preferred embodiment of the present invention adapted for mating with a mating connector comprises an insulative housing 10, a number of first and second contacts 20, 30 received in the insulative housing 10 and an elongated spacer 40 for arranging the first and the second contacts 20, 30. In this embodiment the electrical connector 100 is a quad small form-factor pluggable connector.

Figure 3:
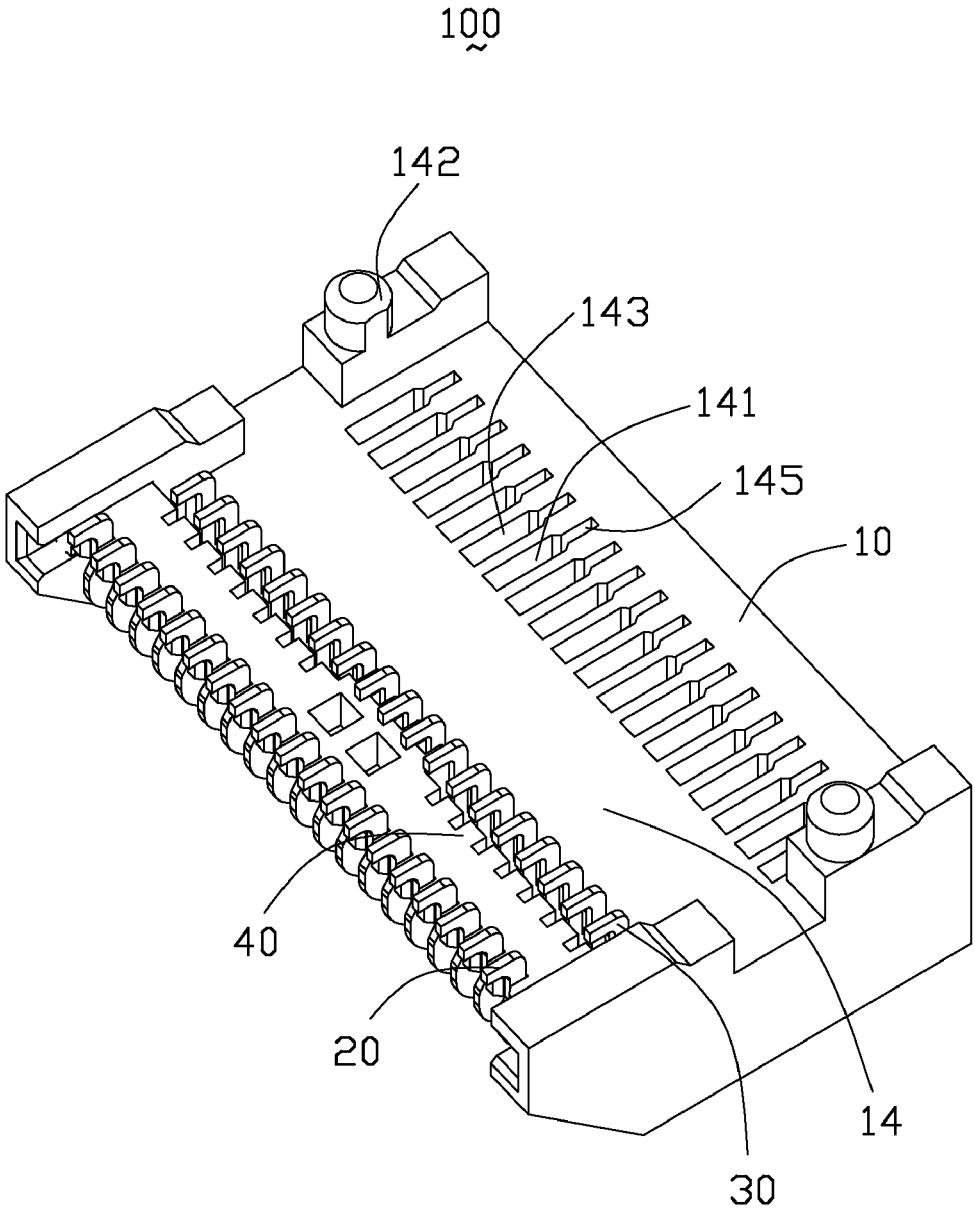
FIG. 3 is a bottom view of the electrical connector as shown in FIG. 1.

Referring to FIGS. 1 to 3, the insulative housing 10 comprises a mating face 101 with a mating opening 11, a rear wall 102 opposite to the mating face 101, a top wall 13, a bottom wall 14 spaced apart from and parallel to the top wall 13 and a pair of parallel and spaced side walls 15 connecting with the top and the bottom walls 13, 14. The mating face 101, rear, top, bottom and side walls 102, 13, 14, 15 cooperate to define a receiving room 110 and communicating with the mating opening 11 for mating with the mating connector. Both of the side walls 15 have a bottom portion extending beyond the bottom wall 14 from the top wall 13 to the bottom wall 14 direction defining a receiving cavity 16 for receiving a portion of the mating connector. Each side wall 15 has a rear portion 150 extending beyond the rear wall 102 defining a mounting slot 151. The rear wall 102 defines a number of rear mounting holes 12 opposite to the mating opening 11 and connecting with the receiving room 110. The rear mounting holes 12 comprises a number of upper rear mounting holes **12*a* and lower rear mounting holes 12*b* offset from the upper rear mounting holes 12*a* respectively. The top wall 13 defines a number of top through holes 131 each defining a top cutout portion 133 for impedance matching and a flat portion 132 for being vacuum suctioned by an automatic pick-up device. The bottom wall 14 defines a number of bottom through holes 141 each defining a bottom cutout portion 143 for impedance matching and a pair of mounting posts 142 for positioning the electrical connector 100 to the PCB. In other words, each of the top through holes 131 comprises a wide portion 133 for impedance matching and a narrow portion 135 for arranging respective first contact 20, and each of the bottom through holes 141 comprises a wide portion 143 for impedance matching and a narrow portion 145 for arranging respective second contact 30. The insulative housing 100 defines respective preloading portions 111 at the top and bottom sides of the receiving room 110 adjacent to the mating opening 11**.

Figure 4:
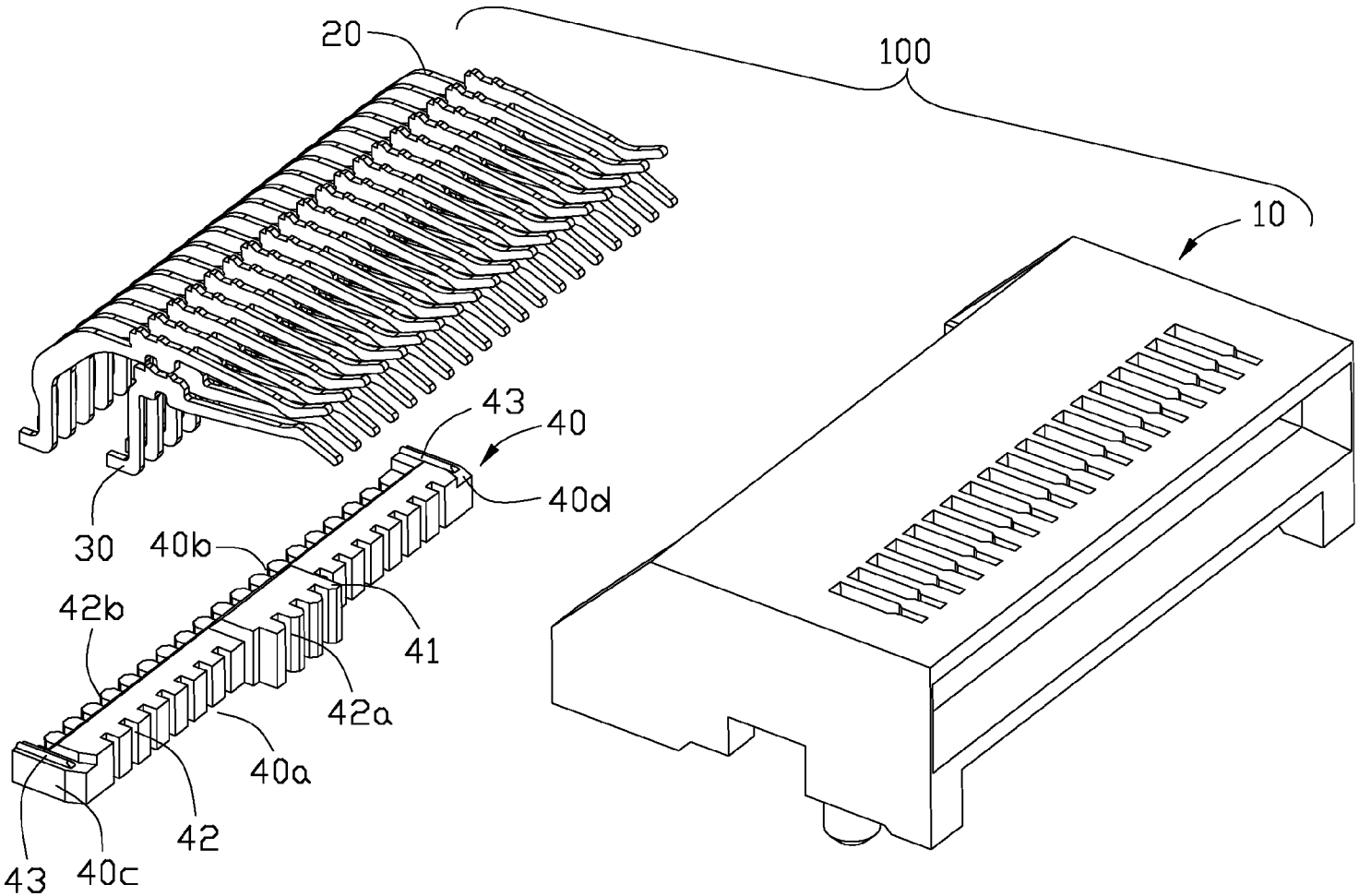
FIG. 4 is an exploded view of the electrical connector as shown in FIG. 1.
Figure 5:
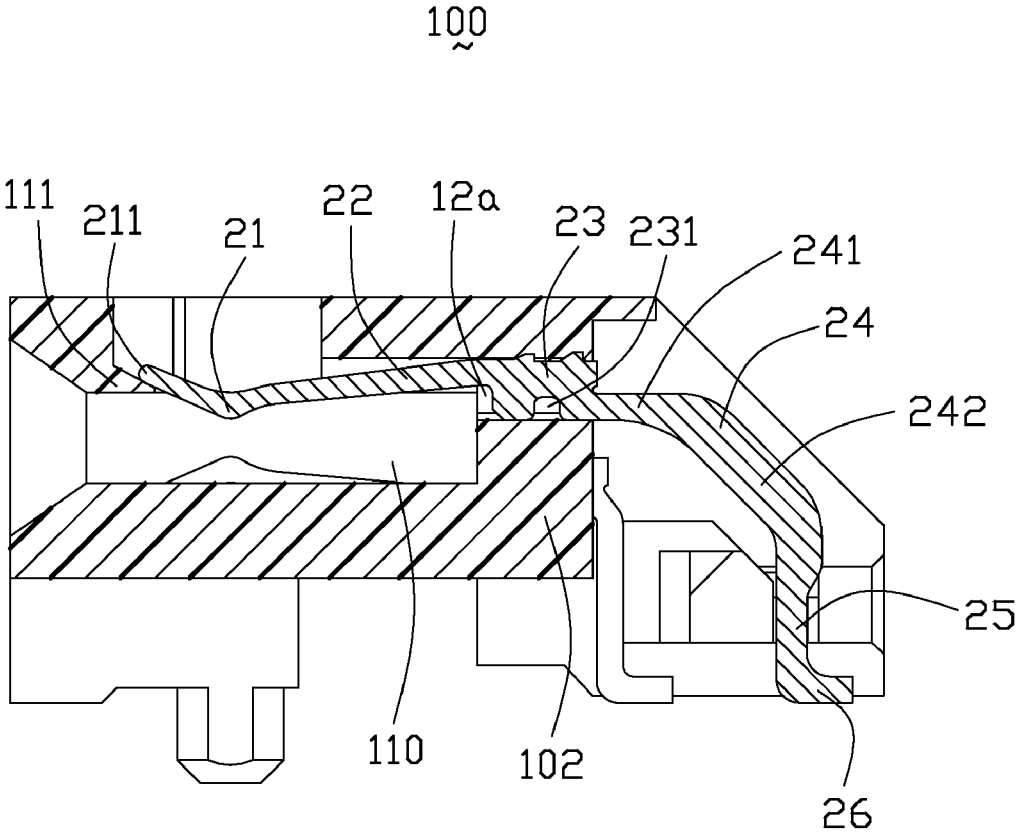
FIG. 5 is a cross-sectional view of the electrical connector taken along line 5-5 of FIG. 1.

Referring to FIGS. 4 and 5, each first contact 20 comprises a first retention portion 23, a first horizontal arm 22 connecting with the first retention portion 23, a first contact portion 21 extending from the first horizontal arm 22 and having a first free end 211, a first soldering portion 26 and a first connecting portion 24 connecting with the first retention portion 23 and the first soldering portion 26. Each first connecting portion 24 comprises a horizontal portion 241 extending from the first retention portion 23, a vertical portion 25 connecting with the first soldering portion 26 and an oblique portion 242 extending obliquely to the first soldering portion 26 and connecting with the horizontal portion 241 and the vertical portion 25. Each first retention portion 23 defines a first concave portion 231 to reduce the cross sectional area of the first retention portion 23 for improving the performance of the high speed data signal transfer.

Figure 6:
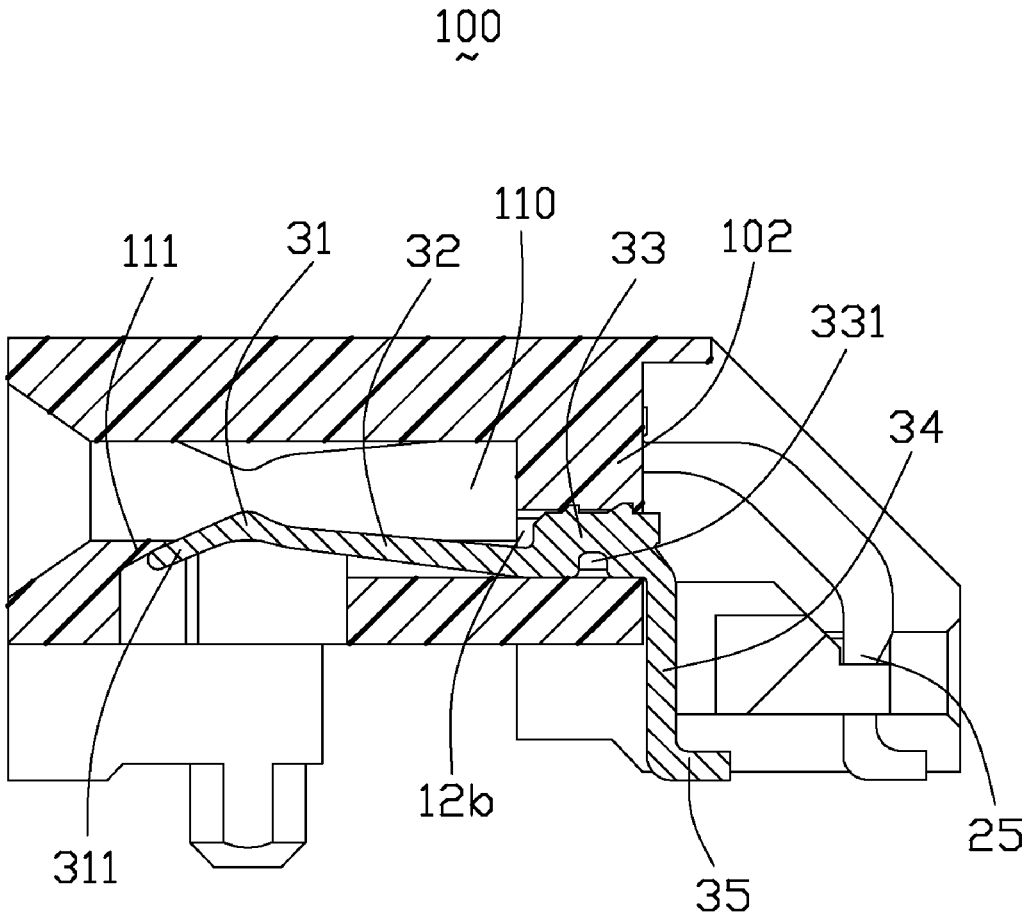
FIG. 6 is a cross-sectional view of the electrical connector taken along line 6-6 of FIG. 1.

Referring to FIGS. 4 and 6, each second contact 30 comprises a second retention portion 33, a second horizontal arm 32 connecting with the second retention portion 33, a second contact portion 31 extending from the second horizontal arm 32 and having a second free end 311, a second soldering portion 35 and a second connecting portion 34 extending in a vertical direction from the second retention portion 33 and connecting with the second retention portion 33 and the second soldering portion 35. Each second retention portion 33 defines a second concave portion 331 to reduce the cross sectional area of the second retention portion 33 for improving the performance of the high speed data signal transfer.

Referring to FIGS. 4 to 6, the first contacts 20 are inserted into the insulative housing 10 through the upper rear mounting holes 12*a* along a back-to-front direction. The first contacts 20 are fixed or securely retained in the insulative housing 10, with the first retention portion 23 having an interference with the upper rear mounting holes 12*a*. The second contacts 30 are inserted into the insulative housing 10 through the lower rear mounting holes 12*b* along a back-to-front direction. The second contacts 30 are fixed in the insulative housing 10, with the second retention portions 33 having an interference with the lower rear mounting holes 12*b*. It is unnecessary to form a retention stick in each of the first and the second contacts 20, 30 so that the high speed data transmits through the first and the second retention portions 23, 33. Therefore, the performance of the high speed data transmission is improved. The first and the second horizontal arms 22, 32 and the first and the second contact portions 21, 31 are exposed in the receiving room 110. The first free ends 211 abut against the top side preloading portion 111. The second free ends 311 abut against the bottom side preloading portion 111. The first contact portions 21 and the first horizontal arms 22 are disposed below the top through holes 131 of the top wall 13 respectively. The second contact portions 31 and second horizontal arms 32 are disposed above the bottom through holes 141 of the bottom wall 14 respectively. Therefore, the first and the second contacts 20, 30 may expose much more area in the air which in turn may improve the impendence matching. The first contacts 20 may be offset from the second contacts 30 respectively.

Referring to FIGS. 2 to 6, the elongated spacer 40 comprises a first side 40*a* disposed adjacent to the insulative housing 10, a second side 40*b* opposite to the first side 40*a*, a first end 40*c* and a second end 40*d* opposite to the first end 40*c*. The first side 40*a* preferably is distanced from the lower second contacts so as not to affect their performance and may comprise a projection portion 41 defining a number of first slots 42*a* for receiving only some of the second connecting portions 34 of the second group contacts 30 that are used to transmit low frequency signal. The projection portion 41 is disposed at a middle portion of the first side 40*a* of the elongated spacer 40. The second side 40*b* defines a number of second slots 42*b* for receiving the first vertical portions 25 of the first contacts 20 respectively. This may be desired because the connecting portion of the upper contact is comparatively longer than the connecting portion of the lower contact and a true position of upper contact connecting portions is needed. The first and the second ends 40*c*, 40*d* both have a mounting block 43 for engaging with the mounting slots 151 of the insulative housing 10.

It is to be understood, however, that even though numerous characteristics and advanarmes of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a front receiving room for receiving a mating connector, and a receiving cavity below and separated from the receiving room for receiving a portion of the mating connector;

a plurality of contacts supported by said insulative housing, the contacts being arranged in distinct sets of upper and lower contacts on opposing faces of said insulative housing, the upper and the lower contacts being inserted into the receiving room along a back-to-front direction; and an elongated spacer supported by said insulative housing, the upper contacts being arranged by the elongated spacer, said elongated spacer defining a plurality of slots extending through the spacer along a top-to-bottom direction for receiving the upper contacts, respectively, each of said slots comprising an opening facing rearward, each of the upper contacts received into the respective slot through the respective opening.

2. The electrical connector as recited in claim 1, wherein said insulative housing defines a pair of mounting slots engaging with the elongated spacer.

3. The electrical connector as recited in claim 2, wherein the pair of mounting slots extend along the back-to-front direction, the elongated spacer being mounted to the mounting slots along the back-to-front direction.

4. The electrical connector as recited in claim 1, wherein said insulative housing comprises a top wall defining a plurality of top through holes, each top through hole having a first portion and a second portion wider than the first portion, and a bottom wall spaced apart from and parallel to the top wall and defining a plurality of bottom through holes, each bottom through hole having a third portion and a fourth portion wider than the third portion.

5. The electrical connector as recited in claim 4, wherein said upper contacts are disposed in the top through holes respectively, and the lower contacts are disposed in the bottom through holes respectively.

6. The electrical connector as recited in claim 4, wherein said top wall of the insulative housing comprises a flat portion that can be vacuum suctioned by an automatic pick-up device.

7. The electrical connector as recited in claim 1, wherein said insulative housing defines a plurality of upper and lower mounting holes communicating with the receiving room, the upper and lower contacts being interference fit with the upper and lower mounting holes respectively.

8. The electrical connector as recited in claim 1, wherein the upper contacts are arranged in a left-to-right direction, and the lower contacts are arranged in the left-to-right direction, each upper contact being offset from each lower contact along the left-to-right direction.

9. The electrical connector as recited in claim 1, wherein each of the upper contacts has a first soldering portion, and each of the lower contacts has a second soldering portion, the second soldering portions being disposed in front of the first soldering portions.

10. The electrical connector as recited in claim 9, wherein all of the first soldering portions and second soldering portions are disposed on a same plane.

11. The electrical connector as recited in claim 9, wherein the elongated spacer is disposed essentially between the first soldering portions and the second soldering portions.

12. The electrical connector as recited in claim 11, wherein said housing and said spacer are arranged with structures to allow the spacer to be assembled to the housing in only said back-to-front direction under condition that all the lower contacts, the spacer and the upper contacts are assembled to the housing in said back-to-front direction in sequence.

13. The electrical connector as recited in claim 1, wherein the insulative housing comprises a pair of mounting posts for positioning onto a PCB.

14. An electrical connector comprising:

an insulative housing defining a receiving room for receiving a mating connector, and a receiving cavity below and separated from the receiving room for receiving a portion of the mating connector, the insulative housing comprising a top wall defining a plurality of top through holes each having a narrow portion and a wide portion, and a bottom wall spaced apart from and parallel to the top wall and defining a plurality of bottom through holes each having a narrow portion and a wide portion; and a plurality of contacts supported by said insulative housing, the contacts being arranged in distinct sets of upper and lower contacts on opposing faces of said insulative housing, the upper contacts being aligned with the top through holes respectively, the lower contacts being aligned with the bottom through holes respectively.

15. The electrical connector as recited in claim 14, further comprising an elongated spacer supported by said insulative housing, the upper contacts being arranged by the elongated spacer.

16. An electrical connector comprising:

an insulative housing defining a horizontal receiving room surrounded by opposite top and bottom walls and opposite side walls, and forwardly communicating with an exterior;

a receiving cavity formed under the bottom wall;

a plurality of upper mounting holes and a plurality of lower mounting holes formed in the housing around a rear face thereof;

a plurality of upper contacts inserted into the receiving room via the corresponding upper mounting holes, respectively;

a plurality of lower contacts inserted into the receiving room via the corresponding lower mounting holes, respectively;

a plurality of upper through holes formed in the top wall and upwardly communicating the receiving room with the exterior;

a plurality of lower through holes formed in the bottom wall and downwardly communicating the receiving room with the receiving cavity; wherein said upper through holes are close to a front portion of the housing and dimensioned to be one half of the top wall in the back-to-front direction while to be one third of a dimension of the whole connector in said back-to-front direction so as to provide ventilation and impedance mating by the upper through holes but also a proper suction area which is positioned behind the upper through holes and essentially on a middle region of the whole housing in the front-to-back direction in a top view.

* * * * *